United States Patent [19]

Eldon, III

[11] 4,328,943

[45] May 11, 1982

[54] CONTROL MECHANISM FOR A CHAIR OR THE LIKE

[75] Inventor: James B. Eldon, III, Barto, Pa.

[73] Assignee: Knoll International, Inc., New York, N.Y.

[21] Appl. No.: 47,118

[22] Filed: Jun. 11, 1979

[51] Int. Cl.[3] ..... A45D 19/04; A47C 3/026

[52] U.S. Cl. ..... 248/578; 248/161; 297/304; 297/328; 297/345

[58] Field of Search ..... 248/578; 297/301-305, 297/364, 269, 270, 328, 345, 369

[56] References Cited

U.S. PATENT DOCUMENTS

| | | | |
|---|---|---|---|
| 2,015,138 | 9/1935 | Drake | 297/303 X |
| 2,424,753 | 7/1947 | Horold | 297/303 |
| 3,434,756 | 3/1969 | Walkinshaw | 297/364 |
| 3,464,663 | 9/1969 | Blomborg | 297/328 |
| 3,711,054 | 1/1973 | Bauer | 248/161 |
| 3,756,654 | 9/1973 | Bauer | 297/345 |
| 3,880,161 | 4/1975 | Scheben | 248/161 |
| 4,018,415 | 4/1977 | Wolters | 248/578 |
| 4,099,775 | 7/1978 | Mizelle | 297/303 |

*Primary Examiner*—Francis K. Zugel

[57] ABSTRACT

A tilt control mechanism for a chair utilizing a control housing and a pivot block mounted for pivotal movement with respect to each other about an axis. An actuator block is supported for movement along that axis and carries a pin thereon. In one position of the actuator block, the pin engages a flange on the control housing, preventing pivotal movement of the control housing with respect to the pivot block. In another position of the actuator block along the axis, pivoting movement is permitted. In a third position of the actuator block along the axis, a gas cylinder mechanism is actuated controlling the height of the chair.

7 Claims, 6 Drawing Figures

30
28
26
24
22
20
10
48
10a
10d
48
32
16
18
18
34
12d
12a
12
12b
12a
12c
14a
36
14
42
38
40
34
46
44

CONTROL MECHANISM FOR A CHAIR OR THE LIKE

BACKGROUND AND BRIEF DESCRIPTION OF THE INVENTION

This invention relates to a control mechanism for a chair or the like, and particularly to a tilt and height control mechanism for a chair.

Tilt controls for chairs are known. Most are cumbersome and complicated, and oftentimes not reliable. The present invention has, for its principal object, the providing of a control mechanism for a chair in which tilting action may be easily and effectively controlled, as well as chair height adjustment.

In a preferred embodiment of the present invention, tilt and height control are achieved through use of a single self-contained adjustment mechanism controlled by a single adjustment lever. In one position of the lever, the chair is "locked" so that it may not be tilted. In another position of the lever, the mechanism is "unlocked" and the chair may be tilted to any comfortable position. In still another position of the lever, the chair height may be adjusted, as desired.

This action is achieved in a preferred embodiment of the invention by use of a control housing that is attached to a chair seat and a pivot block that is attached to a chair pedestal or similar chair support mechanism. The control housing and pivot block are mounted for pivotal movement with respect to each other about a pivot shaft. An actuator block is supported for movement along that shaft and carries a pin thereon. The control housing includes a flange which engages the pin in one of the positions of the actuator block along the shaft, thereby preventing pivotal movement of the control housing and pivot block. In another position of the actuator block along the shaft, the pin and flange are out of disengagement (the flange is discontinuous), so that pivotal movement of the control housing and pivot block can take place. In this fashion the chair is either locked against tilting or unlocked for tilting. In another position of the actuator block along the shaft, a cam surface on the actuator block engages the actuator control of a gas cylinder mechanism, permitting the height of the chair to be adjusted. The position of the actuator block along the pivot shaft may be controlled by a spring-loaded ball carried by the actuator block which engages grooves in the pivot block corresponding to the tilt locking and tilt unlocking positions of the actuator block. The actuator block preferably is spring-biased out of the position thereof along the shaft in which the actuator control of the gas cylinder mechanism is activated.

The assembly preferably includes a wear strip that is mounted to the pivot shaft, is formed of spring metal, and has a surface that is positioned adjacent to the cam surface of the actuator block. The actuator block is moveable along the pivot shaft with respect to the wear strip, and the wear strip is adapted to engage the actuator control of the gas cylinder mechanism.

The control housing and pivot block pivot with respect to each other, as noted above, about the pivot shaft. A coil spring is utilized urging the control housing and pivot block toward a predetermined angular relationship with respect to each other about that shaft. The coil spring provides the conventional restoring force against the tilting of the chair tending to return the chair to a non-tilted position.

The invention will be more completely understood by reference to the following detailed description.

DETAILED DESCRIPTION

Figure 6:
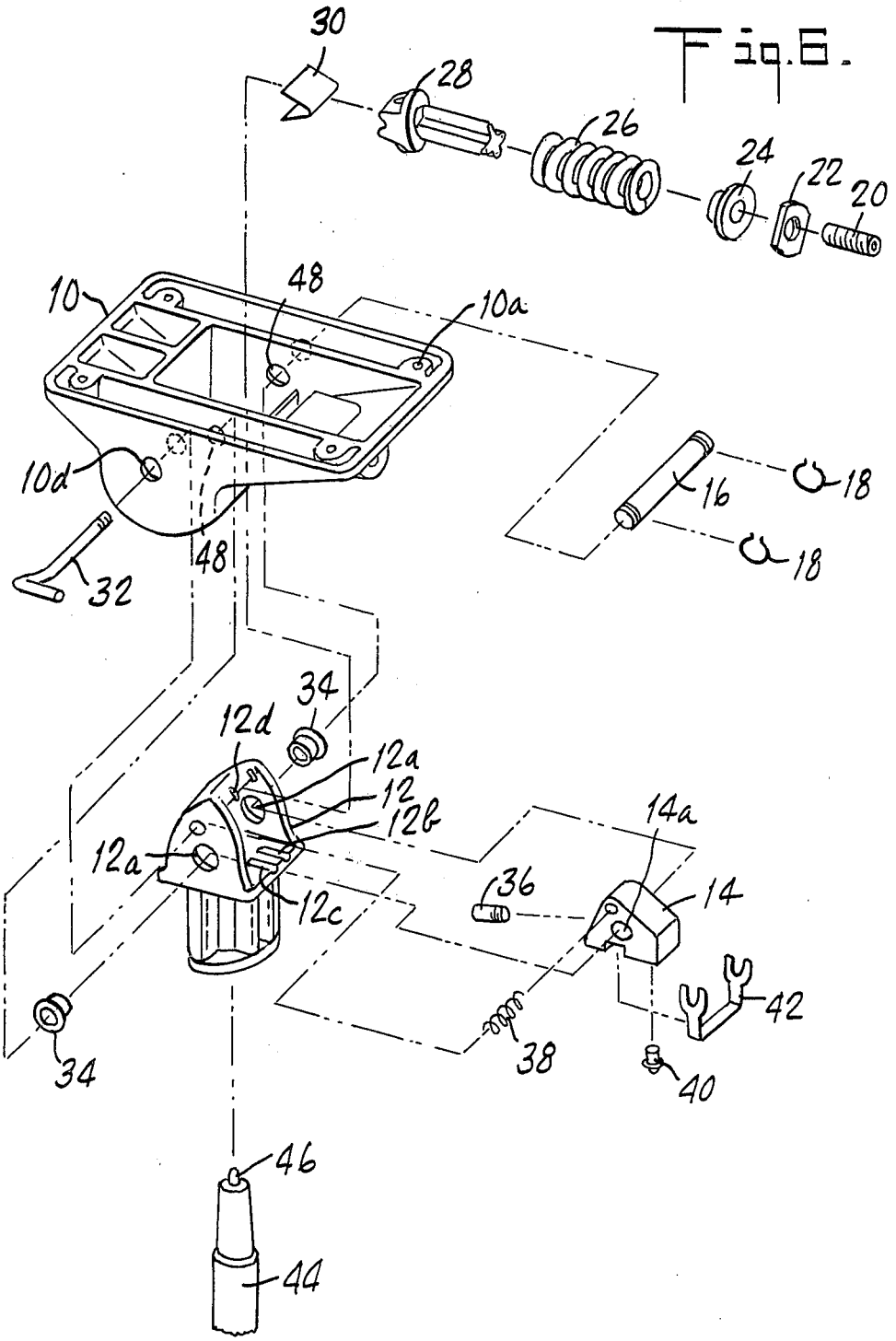
FIG. 6 is an exploded view of the tilt control mechanism of FIG. 1.

Referring first to FIG. 6, the parts that constitute the tilt control mechanism are as follows:

(a) a control housing 10,
(b) a pivot block 12,
(c) an actuator block 14,
(d) a pivot shaft 16,
(e) snap rings 18,
(f) spring tension adjustment screw 20,
(g) threaded nut 22,
(h) spring adjustment washer 24,
(i) coil spring 26,
(j) spring plunger 28,
(k) bearing 30,
(l) adjustment rod 32,
(m) bearings 34 for pivot block 12,
(n) tilt lock pin 36 threaded into actuator block 14,
(o) spring 38,
(p) ball catch 40, and
(q) wear strip 42.

Not forming part of the invention but also shown in FIG. 6 is the upper portion 44 of a gas cylinder mechanism that includes an actuator control 46. The gas cylinder mechanism 44 constitutes the upper portion of a chair pedestal or similar support mechanism (not shown).

Figure 4:
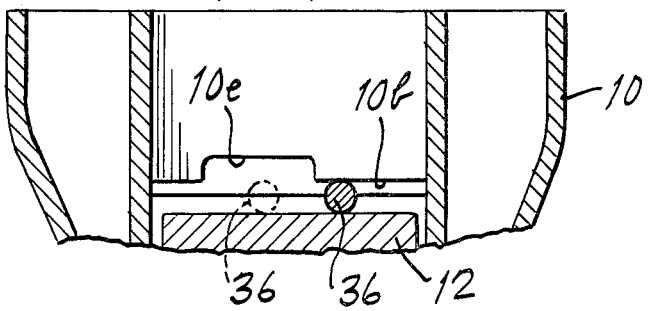

The control housing 10 and pivot block 12 are mounted for pivotal movement with respect to each other about the axis of pivot shaft 16 which is carried in pivot block 12 by virtue of holes **12*a* in that block. The pivot block mounts upon the upper portion of the gas cylinder mechanism 44. Bearings 34 are mounted in holes 12*a* in the pivot block to support the pivot shaft 16. The ends of the pivot shaft 16 are carried in holes 48 in the control housing 10, and snap rings 18 retain the shaft in place. Actuator block 14 rides along the shaft 16, and includes a tilt lock pin 36 which is threaded into the actuator block. This lock pin engages a flanged portion of the control housing, i.e., flange portion 10*b* shown in FIG. 4 in one position of the actuator block along the pivot shaft 16. The flange 10*b* is discontinuous and includes a cut-away portion 10*c* thereof so that, when the pin 36 is in the region of the cut-away portion 10*c*, the control housing 10 is free to pivot with respect to the pivot block 12. Thus, when the actuator block 14 is in the position shown in FIG. 4, the tilt lock pin 36 engages the flange 10*b***, preventing any tilting action.

Movement of the actuator block 14 along the axis of shaft 16 is occasioned by adjustment rod 32 which is threaded into the actuator block 14 and which passes through hole **10*d* in control housing 10**.

The actuator block 14 includes a spring-loaded ball 40 which engages grooves 12*b* and 12*c* in the pivot block 12 in two of the positions of the actuator block 14 along the shaft 16. Specifically, when the ball 40 is in the groove 12*b*, the actuator block is retained in the position shown in FIG. 4, in which the tilt control mechanism is locked against tilting. When the ball 40 rides in the groove 12*c*, the pin 36 is in the dashed line position shown in FIG. 4 (the tilting position of the tilt control mechanism), and the mechanism is retained in this position by the ball in the associated groove.

Figure 3:
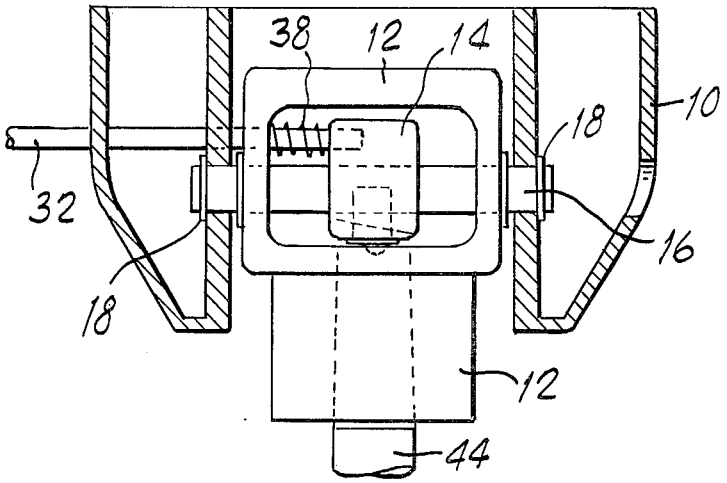
FIGS. 3–5 are partial sectional views, taken generally along the sections 3—3, 4—4 and 5—5 in FIG. 1.
Figure 5:
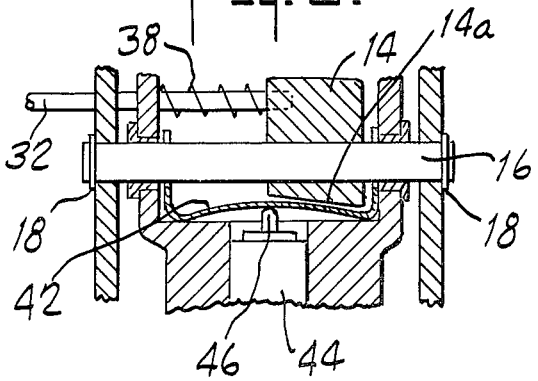

The same adjustment rod 32 is used to control height adjustment by moving it further to the left (with respect to the orientation in FIG. 3). In this case, the actuator block 14 compresses spring 38 (FIG. 3) which tends to return the actuator block 14 to the free tilting position in which the ball 40 rides in the groove 12*c*. When the actuator block 14 is moved to the left with respect to FIG. 3, the actuator block causes the gas cylinder mechanism to be actuated, as shown in FIG. 5. Specifically, the lower part of the actuator block 14 constitutes a cam surface, designated 14*a*. As the actuator block 14 is moved to the left in FIG. 5, the actuator control 46 of the gas cylinder mechanism is activated (by being pushed downwardly) thereby achieving a height adjustment of the chair or other mechanism which is being controlled. As noted, the spring 38 tends to return the actuator block 14 to the position shown in FIG. 5, which is the non-actuated position of the actuator control 46.

To provide better control of the height adjustment mechanism, the wear strip 42 is included. This is a piece of spring metal, for example, shaped in the form of a yoke so that it is positioned fixedly with respect to the pivot shaft 16.

The wear spring 42 is positioned adjacent to the cam surface 14*a*, and the actuator block 14 is free to move along the wear strip. Thus, contact with the actuator control 46 is actually made by the wear strip 42 and not the cam surface 14*a*. This avoids grooving of the cam surface by the actuator control 46.

Figure 1:
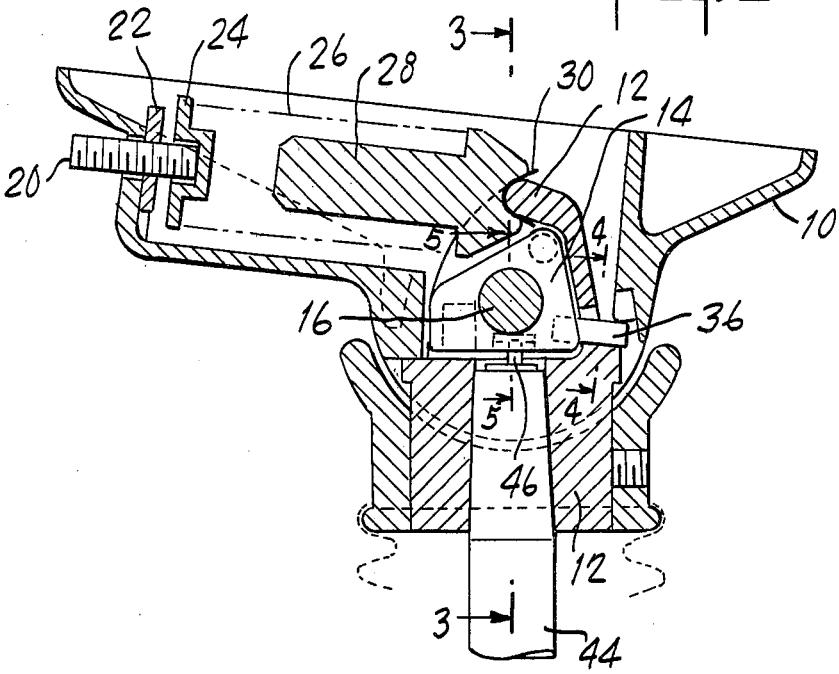
FIG. 1 is a sectional view of a tilt control mechanism embodying the invention.
Figure 2:
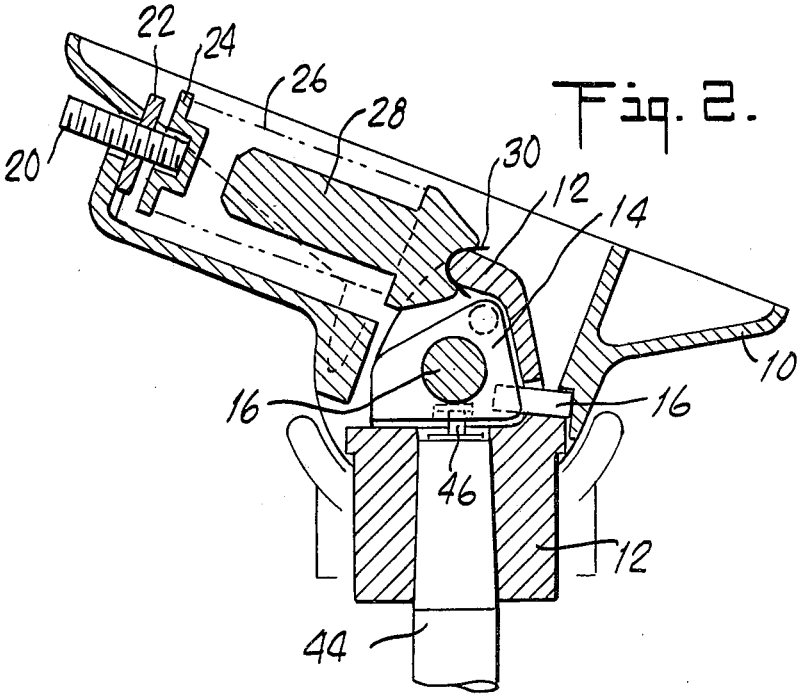
FIG. 2 is a view similar to FIG. 1, showing the tilt control mechanism in a tilting position.

The tilt control mechanism is spring biased by use of spring 26 which is carried by spring plunger 28. The spring adjustment washer 24 rides in one end of the spring 26, as shown in FIG. 1. The threaded nut 22 is carried in the control housing 10, as shown in FIG. 1, and the spring tension adjustment screw 20 is adjusted to control the tension of the spring 26. The spring plunger 28 bears against surface 12*d* of the pivot block 12, as shown in FIG. 1. Bearing 30, which may be of plastic material, serves to prevent wear and provides for smooth, noiseless movement between the end of the spring plunger 28 and the surface 12*d* of the pivot block 12 against which it bears.

In practice, the control housing 10 is mounted on the underside of a chair seat, for example, by means of screws (not shown) which pass through holes 10*a* in the control housing 10. The pivot block 12 is attached to the upper portion of a chair pedestal or similar support mechanism, such as gas cylinder structure 44. The single control rod 32 is used to shift the actuator block 14 between the chair tilt-lock position, chair free-tilt position, and chair raise-lower position, as described above.

It is apparent that the presently preferred embodiment described above is subject to modification. The invention, accordingly, should be taken to be defined by the following claims.

I claim:

1. A tilt control mechanism for a chair or the like comprising a control housing adapted for attachment to a chair seat or the like, a pivot block adapted for attachment to a chair pedestal or like support mechanism, said control housing and pivot block being mounted for pivotal movement with respect to each other about an axis, an actuator block supported for movement along said axis and carrying a pin thereon, said control housing including a flange which engages said pin in a predetermined location of said actuator block along said axis preventing said pivotal movement of said control housing with respect to pivot block, and in another position of said actuator block along said axis, said pin and flange are out of engagement, permitting said pivotal movement of said control housing with respect to said pivot block.

2. A tilt control mechanism according to claim 1 wherein said flange is discontinuous to provide for the disengagement of said pin and flange.

3. A tilt control mechanism according to claim 1, in which said actuator block includes a spring-loaded ball, and said pivot block is grooved for engagement with said ball to yieldably retain said actuator block in at least one of said positions of said actuator block along said axis.

4. A tilt control mechanism according to claim 1, in which said actuator block includes a cam surface thereon adapted to engage the actuator control of a gas cylinder mechanism for controlling the height of said chair or the like.

5. A tilt control mechanism according to claim 4, in which said actuator block moves along a pivot shaft, and including a wear strip mounted to said pivot shaft and formed of spring metal and having a surface positioned adjacent to said cam surface, said actuator block being movable along said pivot shaft and said wear strip, with said wear strip being adapted to engage said actuator control of said gas cylinder mechanism.

6. A tilt control mechanism according to claim 1, including a coil spring having one end bearing against a portion of said control housing and another end bearing against said pivot block, said coil spring urging said control housing and pivot block toward a predetermined angular relationship with respect to each other.

7. A tilt control mechanism according to claim 1, said actuator block including a spring-loaded ball, and said pivot block is grooved for engagement with said ball to yieldably retain said actuator block in at least one of said positions of said actuator block along said axis, said actuator block including a cam surface thereon adapted to engage the actuator control of a gas cylinder mechanism for controlling the height of said chair or the like, and said actuator block being spring-biased away from a position along said axis in which said actuator control is engaged to actuate said gas cylinder mechanism, said axis being defined by a pivot shaft along which said actuator block moves, and a coil spring having one end bearing against a portion of said control housing and another end bearing against said pivot block, said coil spring urging said control housing and pivot block toward a predetermined angular relationship with respect to each other about said pivot shaft.

* * * * *

UNITED STATES PATENT AND TRADEMARK OFFICE

CERTIFICATE OF CORRECTION

PATENT NO. : 4,328,943

DATED : May 11, 1982

INVENTOR(S) : James Bender Eldon

It is certified that error appears in the above—identified patent and that said Letters Patent is hereby corrected as shown below:

Column 4, line 20, after "claim 1" insert -- or 7, --.

Signed and Sealed this

*Thirteenth* Day of *July 1982*

[SEAL]

*Attest:*

GERALD J. MOSSINGHOFF

*Attesting Officer*

*Commissioner of Patents and Trademarks*